United States Patent [19]

Cognard et al.

[11] Patent Number: 5,060,834

[45] Date of Patent: Oct. 29, 1991

[54] WRISTLET OF PLASTIC MATERIAL

[75] Inventors: Jacques Cognard, Neuchâtel, France; Claude Ganguillet, Cortaillod, Switzerland

[73] Assignee: ETA SA Fabriques d'Ebauches, Switzerland

[21] Appl. No.: 439,912

[22] Filed: Nov. 21, 1989

[30] Foreign Application Priority Data

Nov. 25, 1988 [FR] France ..... 88 15647

[51] Int. Cl.[5] ..... A44C 5/00

[52] U.S. Cl. ..... 224/178; 224/164

[58] Field of Search ..... 224/178, 179, 164; 63/3; 368/282, 281

[56] References Cited

U.S. PATENT DOCUMENTS

| | | | |
|---|---|---|---|
| 3,378,181 | 4/1968 | Hirsch | 224/178 |
| 3,396,884 | 8/1968 | Herzog | 224/178 |
| 3,899,378 | 8/1975 | Wragg et al. . | |
| 3,939,027 | 2/1976 | Ohya et al. . | |
| 4,700,874 | 10/1987 | Mock et al. . | |

FOREIGN PATENT DOCUMENTS

| | | | |
|---|---|---|---|
| 2039998 | 3/1972 | Fed. Rep. of Germany | 224/178 |
| 2840127 | 3/1980 | Fed. Rep. of Germany | 224/178 |
| 1442279 | 7/1976 | United Kingdom | 224/178 |

*Primary Examiner*—Linda J. Sholl

*Attorney, Agent, or Firm*—Pollock, Vande Sande & Priddy

[57] ABSTRACT

A wristlet e.g. for watches in which, to avoid soiling, an outer layer of a fluorinated polymer material is adhered to a band of a non-fluorinated thermoplastic material which forms the body of the wristlet.

12 Claims, 1 Drawing Sheet

WRISTLET OF PLASTIC MATERIAL

FIELD OF THE INVENTION

The present invention relates to wristlets of plastic material.

BACKGROUND OF THE INVENTION

At the present time, the only materials used to manufacture wristlets of plastic materials, notably wristlets of plastic material for watches, are non-fluorinated thermoplastic materials.

These materials are very cheap and are very easily brought into use by hot injection in a suitable mould which is the technology most frequently used for the manufacture of these wristlets of plastic material. In addition it is easy to give these wristlets the requisite pliability by mixing suitable plasticizers into these non-fluorinated thermoplastic materials before use.

However, the wristlets manufactured from these non-fluorinated thermoplastic materials have the great disadvantage that they become dirty relatively quickly during wear, which of course spoils their appearance.

BRIEF SUMMARY OF THE INVENTION

It is an object of the present invention to provide a wristlet, notably a wristlet for a watch, which does not have this disadvantage, that is which does not become dirty during wear, whilst retaining the advantages of ease of manufacture, low selling price and pliability of the known wristlets mentioned hereinabove.

This object is achieved in that the wristlet of the invention comprises an outer layer of a fluorinated polymer material.

BRIEF DESCRIPTION OF THE INVENTION

The present invention will now be described in detail with reference to the enclosed drawing, in which:

FIGS. 1 to 3 are transverse diagrammatic and partial sections of the three embodiments of the wristlet according to the invention.

DETAILED DESCRIPTION OF THE INVENTION

Fluorinated polymer materials are known to have a very low surface tension. As a consequence of this property they virtually never become dirty and they therefore always maintain the same appearance.

These fluorinated polymer materials are however very expensive and relatively rigid. It is therefore not possible to use them to manufacture wristlets which have to be both pliable and cheap.

Figure 1:
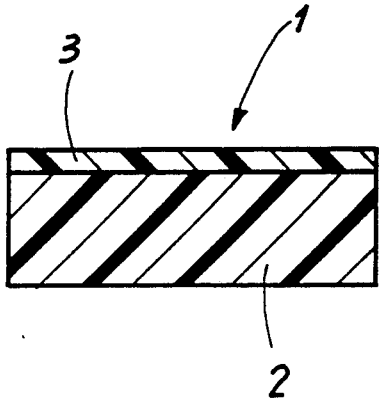

In the embodiment shown as a non-limiting example in FIG. 1, the wristlet of the invention, designated with the reference numeral 1, is substantially composed of a band 2, one of the faces of which is intended to come into contact with the wrist of the wearer of this wristlet.

This band 2, which forms the body of the wristlet, is executed in a non-fluorinated thermoplastic material which can be any one of the numerous materials of this type which are in common use for the manufacture of watch wristlets.

It is not possible to list herein all these non-fluorinated thermoplastic materials. For purposes of non-limiting examples, it suffices to mention polyvinyl chlorides, polyurethanes and polyether-amide block copolymers such as those sold under the trade name Pebax by Société Atochem in Serquigny, France.

The wristlet 1 of FIG. 1 further comprises an outer layer 3 formed of a fluorinated polymer material and covering the face of the band 2 opposite that which is intended to come into contact with the wrist of the wearer of the wristlet.

This layer 3 is solidly fixed to the band 2 in a manner to be described hereinbelow.

It is also not possible to list herein all these fluorinated polymer materials here. Reference will simply be made, again as non-limiting examples, to fluor-ethyl-propyl copolymers sold by Dupont de Nemours Suisse S.A. in Geneva (Switzerland) and to polyvinyl fluorides such as those sold under the trade name Tedlar by the same company.

It should be noted here that fluorinated polymer materials can be produced in the form of very thin continuous films, that are for example a few tens of micrometres thick.

Due to this small thickness, films of this kind are very pliable, despite the natural rigidity of fluorinated polymer materials.

The layer 3 can therefore have a very small thickness so that it does not substantially reduce the pliability of the wristlet 1 which is essentially determined by the pliability of the non-fluorinated thermoplastic material forming the band 2.

Since fluorinated polymer materials have a very low surface tension, the presence of this layer 3 prevents dirt of any kind from becoming attached to the outer surface of the wristlet 1 which thus retains its appearance indefinitely whilst being worn.

However, for the same reason, it is not possible to manufacture the wristlet 1 using for the layer 3 a film of a fluorinated polymer material unless this film has previously undergone treatment enabling this layer 3 to adhere solidly to the band 2.

Manufacturers of fluorinated polymer materials list in their catalogues films of these materials, one face of which has already undergone such treatment, without divulging the nature of this treatment, which is one of their manufacturing secrets.

The wristlet 1 of FIG. 1 can, for example, be manufactured by first of all cutting pieces out of a film of the fluorinated polymer selected for the layer 3 and treated in the manner described above, each of which has the shape and the dimensions which this layer 3 has to have in the finished wristlet 1.

Each piece cut in this manner is then placed in a conventional injection mould having the shape and the dimensions which the wristlet 1 has to have in such a way that its treated face is directed towards the inside of this mould.

The non-fluorinated thermoplastic material selected for the layer 2 is then injected into this mould, also in classic manner.

After cooling and solidification of the non-fluorinated thermoplastic material, the band 2 and the layer 3 adhere solidly to one another thanks to the pre-treatment undergone by the layer 3.

Handling the pieces designed to form the layer 3, notably their introduction at the desired location in the injection mould, can pose problems because of their very small thickness.

To avoid these problems it is for example possible to adhere a thin layer of a non-fluorinated thermoplastic material, which is preferably, but not essentially, the same as that selected for the band 2, to the face of the film of fluorinated polymer material which has been treated in the manner mentioned above. This adhesion can be achieved, for example, by laminating this film and this layer together under heat.

After cooling, this film and this layer, which adhere strongly to one another, are cut into pieces, each having the shape and the dimensions which the layer 3 has to have in the wristlet 1.

One of the pieces cut out in this manner, which is easier to handle than in the previous case due to its larger thickness, is then placed in the injection mould in such a way that its face formed by the layer of non-fluorinated thermoplastic material is directed towards the inside of the mould.

The non-fluorinated thermoplastic material selected for the band 2 is then injected into the mould, as hereinabove.

After cooling, the band 2 and the layer mentioned above adhere strongly to one another.

In such a case, the adhesion of the layer 3 to the band 2 is thus effected by the intermediary of this layer of non-fluorinated thermoplastic material which, in the finished wristlet is disposed between this layer 3 and the band 2.

Figure 2:
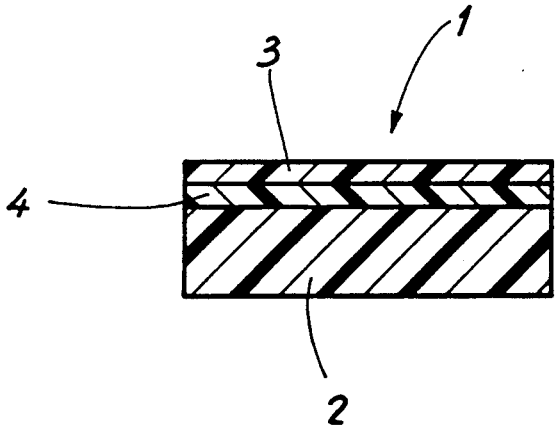

FIG. 2 illustrates a wristlet produced in this manner.

In this FIG. 2, the reference numerals 1, 2 and 3 designate respectively the same elements as in FIG. 1 and the reference numeral 4 designates the layer of non-fluorinated thermoplastic material ensuring the adhesion of the layer 3 to the band 2.

It should be noted that if the layer deposited on the film of fluorinated polymer material is a layer of the same material as that which forms the band 2, the finished wristlet has virtually the same constitution as that of FIG. 1.

During injection of the material of the band 2 this mixes intimately with that of the layer 4 and this band 2 and this layer 4 can no longer be distinguished from one another in the finished wristlet.

In another embodiment of the wristlet of the invention which is also illustrated in FIG. 2, the layer 4 ensuring adhesion of the layer 3 to the band 2 is a layer of adhesive.

The manufacture of this wristlet is slightly different from that of other wristlets described above. This manufacture comprises injection of the non-fluorinated thermoplastic material selected for the band 2 in a suitable mould without prior introduction into this mould of the piece of fluorinated polymer film designed to form the layer 3.

After this injection the band 2 and the layer 3 previously cut out of a film of the material selected for this layer 3, treated in the manner referred to above, are glued to one another in a manner that will not be described herein since it is well known.

It should, however, be noted that the face of the layer 3 designed to come into contact with the layer of adhesive 4 must of course be that which has been treated for these layers 3 and 4 to adhere to one another.

The choice of the adhesive intended to form the layer 4 naturally depends on the materials used for the band 2 and for the layer 3 and on the preliminary treatment of this layer 3. It is therefore not possible to list here all the adhesives that can be used which are, moreover, well known to the person skilled in the art.

Another possibility for manufacturing the wristlets of the invention consists in making adhere, for example by heat lamination, a layer of the non-fluorinated thermoplastic material selected for the band 2, having the thickness which this band 2 must have in the finished wristlet, to a film of the fluorinated polymer material selected for the layer 3, and in cutting the wristlets out of the composite sheet or band thus formed, for example by die stamping.

Figure 3:
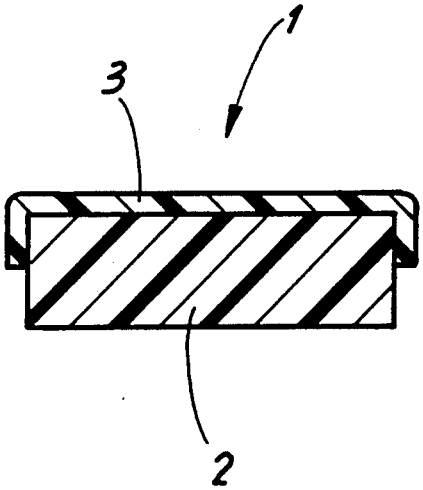

In another embodiment of the wristlet according to the invention, shown in FIG. 3, the layer of fluorinated polymer material, designated with the reference numeral 3 as in the other figures, not only covers one of the faces of the band of non-fluorinated thermoplastic material, also designated by the reference numeral 2, but also part of the sides of this band 2.

In other embodiments that are not shown, the fluorinated polymer layer entirely covers the sides of the band of non-fluorinated thermoplastic material, or even a part of the face of this band designed to come into contact with the wrist of the wearer of the wristlet.

In all these latter embodiments the layer of fluorinated polymer material can adhere to the band of non-fluorinated thermoplastic material either directly, as is the case in FIG. 3, or via the intermediary of a layer of another non-fluorinated thermoplastic material or of adhesive.

In these latter embodiments, the wristlet 1 is clearly even better protected against soiling than in the embodiments of FIGS. 1 and 2.

What is claimed is:

1. A wristlet comprising:

a band of a pliable non-fluorinated plastic material having a face for contacting the wrist of a wearer of the wristlet, and an opposite face; and an outer layer of fluorinated polymer material adhered to said band and covering at least said opposite face, said fluorinated polymer material having a sufficiently low surface tension to substantially prevent dirt from becoming attached to the outer surface of said wristlet during the wearing thereof, and said outer layer being formed by a piece of fluorinated polymer film having the shape and dimensions of said outer layer and a sufficiently small thickness for the pliability of said wristlet to be determined substantially by the pliability of said band.

2. A wristlet according to claim 1, wherein said outer layer adheres directly to said band.

3. A wristlet according to claim 1, which further comprises an intermediate layer disposed between, and adhering to, said outer layer and said band.

4. A wristlet according to claim 3, wherein said band is of a non-fluorinated thermoplastic material, and said intermediate layer is of non-fluorinated thermoplastic material different from that constituting said band.

5. A wristlet according to claim 3, wherein said intermediate layer is a layer of adhesive.

6. A wristlet according to claim 1, wherein said outer layer also covers at least a part of the sides of said band.

7. A wristlet according to claim 2, wherein said outer layer also covers at least a part of the sides of said band.

8. A wristlet according to claim 3, wherein said outer layer also covers at least a part of the sides of the band.

9. A wristlet according to claim 4, wherein said outer layer also covers at least a part of the sides of the band.

10. A wristlet according to claim 5, wherein said outer layer also covers at least a part of the sides of the band.

11. A wristlet according to claim 1 wherein the non-fluorinated plastic material of said band is molded to said outer layer of fluorinated polymer material.

12. A wristlet according to claim 3 wherein said band and said intermediate layer are each of a non-fluorinated thermoplastic material, and an inner surface of said intermediate layer is fixed to said opposite face of the band by a mixture of the thermoplastic material of said intermediate layer and the thermoplastic material of said band.

* * * * *